United States Patent [19]

McLaughlin

[11] Patent Number: 4,731,967

[45] Date of Patent: Mar. 22, 1988

[54] CHIMNEY CONSTRUCTION

[76] Inventor: Stephen D. McLaughlin, R.F.D. 1, Box 101, Lincolnville, Me. 04849

[21] Appl. No.: 78,831

[22] Filed: Jul. 28, 1987

[51] Int. Cl.[4] ..... E04H 12/28

[52] U.S. Cl. ..... 52/218; 52/219; 126/307 R

[58] Field of Search ..... 52/218, 219; 126/307 R; 98/46

[56] References Cited

U.S. PATENT DOCUMENTS

| | | | |
|---|---|---|---|
| 861,481 | 7/1907 | Poston | 98/46 |
| 2,275,902 | 3/1942 | Hasenburger et al. | 52/219 X |
| 2,277,436 | 3/1942 | Howle | 52/219 X |
| 2,304,500 | 12/1942 | Hoesli | 52/218 X |
| 2,462,383 | 2/1949 | Goodwin | 52/219 X |
| 2,706,395 | 4/1955 | McCrea | 52/219 |
| 3,574,983 | 4/1971 | Kreider | 52/219 |
| 4,616,457 | 10/1986 | Yoder et al. | 52/218 |

*Primary Examiner*—Carl D. Friedman

[57] ABSTRACT

The invention provides a chimney structure comprising a base member of fireproof material and a hollow metallic core resting on said base member enclosed in an outer shell which is spaced from the latter. The core comprises a stacked series of individual hollow stainless steel sections joined together to define a vertical flue of the required length extending upwardly from the base member having at least one opening at a desired height above the base suitable for use as a clean-out and/or appliance connection. The shell is a vertical enclosure surrounding and spaced from the core and comprises vertically stacked box-like units assembled from four calcium silicate panels each and holding blocks separating the units from each other vertically, the lowermost unit resting on the base member. Each holding block is provided with a radially inwardly extending flange engaging the core and holding it centered within the enclosure and an outwardly extending flange for receiving and seating the top and bottom edges of successive box-like units respectively. Lateral spacing blocks of calcium silicate space the exterior surfaces of the assembled panel units from any flammable materials surrounding the chimney structure. The invention includes a kit of the necessary parts and the method of raising the structure.

22 Claims, 12 Drawing Figures

CHIMNEY CONSTRUCTION

This invention relates to chimney construction and is directed to a new and improved chimney and method of making the same which is especially adapted for integration with existing abutting flammables in a building.

BACKGROUND OF THE INVENTION

There have been many prior chimney structures comprising a central flue or core surrounded by a shell which may or may not be spaced from the core surface. In some cases, as in U.S. Pat. No. 1,272,503, both the central core and the shell are built up from stacked structural units. In this patent the space between the core and the shell is especially designed to provide circulation of air to cool the core. A similar construction is disclosed in U.S. Pat. Nos. 861,481 and 2,302,500.

Also, the prior art has taught the provision of appliance openings to a core-shell chimney at various levels within a building. Examples are U.S. Pat. Nos. 515,427 and 1,484,328.

So far as I am aware none of the prior art structures and methods have addressed the problem of integrating the chimney with interior building finish in a simple manner which permits the exposed chimney surface to merge with the surface of an interior partition or wall and at the same time neatly solved the problem of providing sufficient isolation from flammables within the building, such as floors, walls and roof. Furthermore, so far as I am aware, the prior art has not suggested a system and materials of construction which are sufficiently light weight and easily handled to permit a chimney to be assembled using only simple tools and to rest its base at any desired floor level in a building.

The object of the invention is to provide a novel method, structure and kit for overcoming the problems just enumerated.

SUMMARY OF THE INVENTION

In accordance with the invention there is provided a chimney structure comprising a base member of fireproof material and a hollow metallic core resting on said base member enclosed in an outer shell. The said core comprises a stacked series of individual hollow cylindrical metal sections joined together to define a vertical flue of the required length extending upwardly from the base member having at least one opening at a desired height above the base suitable for use as a clean-out and/or appliance connection. The shell is a vertical enclosure surrounding and spaced from the core and comprises vertically stacked box-like units formed of at least three side panels each and holding blocks separating said units from each other vertically, the lowermost of said units resting on said base member. Each holding block is provided with a radially inwardly extending flange engaging the core and holding it centered within the enclosure and an outwardly extending flange for receiving and seating the top and bottom edges of successive box-like units respectively. The panels and holding blocks are composed of high structural strength non-flammable thermal insulating material. Lateral spacing blocks of similar material space the exterior surfaces of said panels from any flammable materials surrounding the chimney structure.

In preferred embodiments, the base member, panels, holding blocks and spacing blocks are composed of calcium silicate; each of the said units comprises four rectangular panels of calcium silicate joined together at their vertical edges; the core is composed of tubular sections of sheet stainless steel, the latter being joined together by riveting; the base member is located at the ground level of a building and said structure is provided with a clean-out opening at ground level and an appliance connection opening at a higher level; means may be provided for mounting the base member as an elevation above the chimney base; an uppermost holding block centers the core at its upper end, the uppermost stainless steel section having its upper edge flush with the upper surface of the said block and a flanged terminal stainless steel section is fitted within the open end of said uppermost stainless steel section with its flange covering in part the upper surface of the said uppermost holding block.

Still further, in preferred embodiments, the spacing blocks are integrated with a wall of a building; the space between the core and the surrounding enclosure is filled with nonflammable insulating material.

The invention also includes a kit for raising the novel chimney. The kit comprises a base member of fireproof material for placing at the foot of the chimney for supporting the remaining components, hollow metallic core sections adapted to be stacked vertically and fastened to each other at their rims with the lowermost thereof resting on the said base member to define a continuous central core and at least one of the said sections of the core having an opening at a desired height above the base when the said section is in its stacked position suitable for use as a clean-out and/or appliance connection. The kit also includes rectangular panels of substantially the same height as said core sections adapted to be fastened to each other along their edges in sets of four to form box-like members open at both ends with the one of the said box-like members surrounding the one of said sections having an opening being provided with an opening in registry therewith, and generally rectangular holding blocks each having a central opening sized to fit the outer circumference of the core and a peripheral flange adapted to seat an open end of a box-like member. The said box-like members are adapted to be stacked one upon another separated by the blocks to define a vertical enclosure surrounding and spaced from said core with the lowermost resting on the base member. The panels and holding blocks are composed of high structural strength non-flammable thermal insulating material. Finally, the kit also comprises lateral spacing blocks of similar material adapted to be secured to the outer surfaces of the box-like members for separating the exterior surfaces of the panels from any flammable materials surrounding the raised chimney structure.

In a preferred kit the base member, panels, holding blocks and spacing blocks are composed of calcium silicate and the core sections comprise cylindrical tubular sections of sheet stainless steel and the kit includes an uppermost holding block for centering the core at its upper end with the uppermost section having its upper edge flush with the upper surface of the said block and a flanged terminal stainless steel section adapted to be fitted within the open end of the said uppermost section with its flange covering the upper surface of the said uppermost holding block.

The invention also includes the method of raising a light-weight chimney structure which comprises providing a base on a suitable supporting surface, mounting a first stainless steel tubular section closed with stainless steel bottom cap thereon, attaching four rectangular calcium silicate side panels to each other to form a box-like unit open at both ends and mounting the same on said base by attaching it to the upper surface thereof with the interior of the said box-like unit spaced from the periphery of the tubular section, slipping a second tubular section partially into the top of the first and attaching it thereto to provide an upward prolongation thereof, providing a holding block having a central opening adapted to receive and fit a tubular section for centering the same in the structure and a peripheral flange adapted to seat an open end of a box-like unit and mounting it on top of said first box-like unit, the joint between the tubular sections being received in the said central opening continuing the raising by stacking additional box-like units, tubular sections and holding blocks on those below, the stacked sections defining a central core and the stacked box-like units a shell surrounding and spaced from said core, and terminating the structure with an uppermost block having the upper edge of the uppermost tubular section flush therewith and a flanged terminal section fitted within the open end of said last named section with its flange covering the upper surface of said uppermost block.

A preferred method includes the step of attaching spacing blocks of calcium silicate to the exteriors of at least some of the side panels at suitable elevations to insulate the chimney structure from any surrounding flammables as the structure is raised through either a floor or ceiling, holding the panels to each other and to the corresponding base and blocks by screws, riveting the stainless steel sections together, joining the said shell with a wall flush therewith and finishing the flush surfaces by taping and skim-coating with a plaster mix and filling the space between the steel core and the surrounding shell with insulation.

Still further objects, features and advantages of the novel chimney structure of the invention will become apparent from the following detailed description of a preferred embodiment thereof taken in conjunction with the accompanying drawings.

BRIEF DESCRIPTION OF DRAWINGS

FIG. 11 is an exploded view in perspective of the components of a single unit of the chimney indicating how they are assembled including spacing blocks for engagement with abutting flammable partitions.

DETAILED DESCRIPTION OF PREFERRED EMBODIMENT OF STRUCTURE

Figure 4:
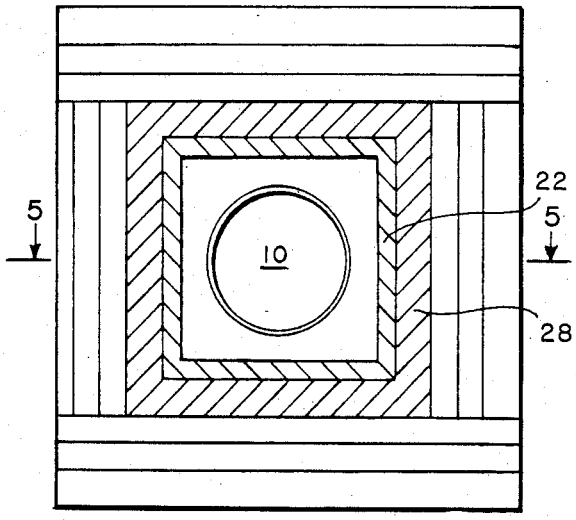
FIG. 4 is a horizontal cross-section taken on line 4—4 of FIG. 5.

In a presently preferred emobodiment of the structure of the invention there is provided an inner core 10 of single-wall stainless steel pipe formed from stacked and joined sections of a suitable length. This inner core extends from bottom to top of the chimney and is provided at a suitable level with one or more ports or openings 12 for use either as an appliance outlet or a clean-out. A thimble 14 is placed in any clean-out and/or appliance outlet 12 of the inner core 10. The inner core is surrounded by and spaced from a non-flammable, self-supporting shell or enclosure 15 assembled from panels 22 as hereinafter described. The entire chimney structure is indicated generally by the numeral 18.

Figure 1:
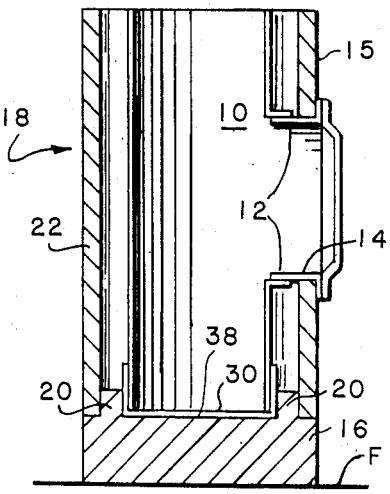
FIG. 1 is a vertical section through the base portion of a chimney emboding the invention.
Figure 2:
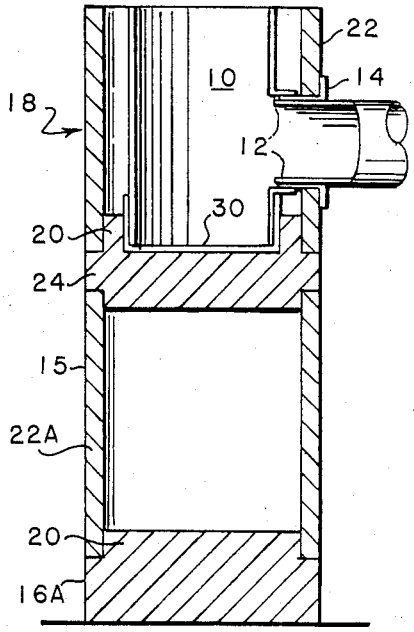
FIG. 2 a similar view of a modified base construction.

As seen in FIG. 1, the core 10 rests on a base block 16 made of calcium silicate or equivalent, placed either at the bottom of the chimney 18, or on a holding block 24 mounted at an appropriate height thereabove (as seen in FIG. 2). The base 16 (FIG. 1) or bottom 16A (FIG. 2) is shaped to provide upper male sides 20 for the fastening of side panels 22 As seen in FIG. 2, the block 24 is supported on panels 22A the bottom edges of which are attached to block 16A. The side panels 22 (or 22A) too are composed of high structural strength material having a high thermal insulating value, preferably calcium silicate. Four side panels are joined together at their vertical edges to define a hollow unit, or rectangular tube, surrounding a portion of the inner chimney core. These units are stacked, suitably joined to each other, as described below, to provide the enclosure for the central core to whatever height is desired.

Figure 6:
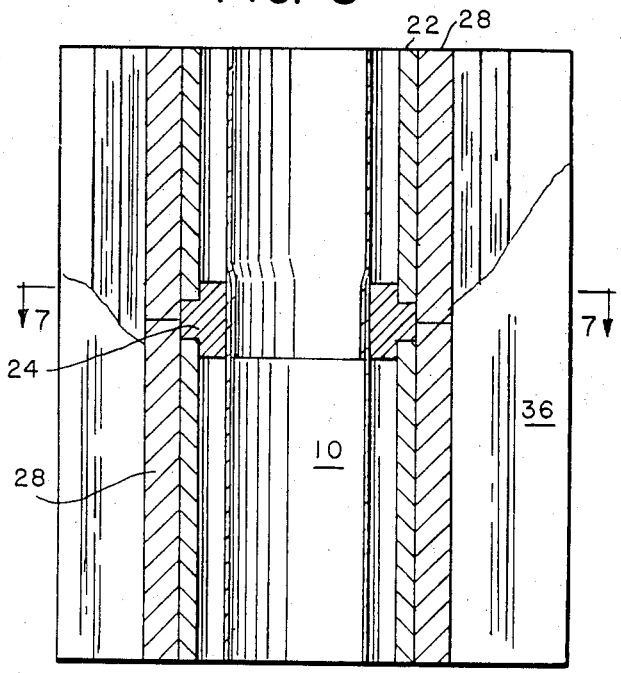
FIG. 6 is a vertical section of a portion of the chimney integrated with an adjacent flammable wall or partition of a building.

Joining successive units to each other in a vertical stack are holding blocks 24, also made of calcium silicate, through which the inner core 10 of stainless steel pipe also passes and to which the side panels 22 are attached by screws (not shown) on the top and bottom male portions 20. The top cap 24A, made of calcium silicate, is the uppermost holding block having only one male side which faces downward, for the attachment of side panels 22 in the last uppermost section and through which the last uppermost section of the stainless steel inner core 10 passes. Additionally, spacing blocks 28, also made of calcium silicate, are used to fill the required two-inch air space between the chimney structure 18 and any abutting flammables as the structure passes through floors or ceilings 19 and roof 32, and as the structure abuts walls and partitions 36 (FIG. 6). Bottom cap 30 is made of stainless steel and is used to seal the bottom-most section of the stainless steel core 10 and to catch any moisture from condensation or from weather conditions The base block 16, being of a suitable thickness to prevent a burn-through under a worst case situation, is placed and aligned so that the structure may be erected in such a manner that a two-inch clearance is allowed from all surfaces as the structure passes through floors, ceilings and roof and to allow for a two-inch clearance from abutting walls and partitions.

Figure 9:
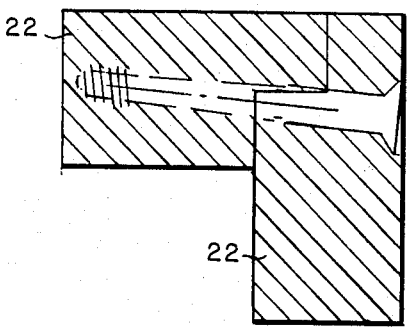
FIG. 9 is a fragmentary sectional view showing how abutting vertical edges of the panels are fastened together by screws.
Figure 8:
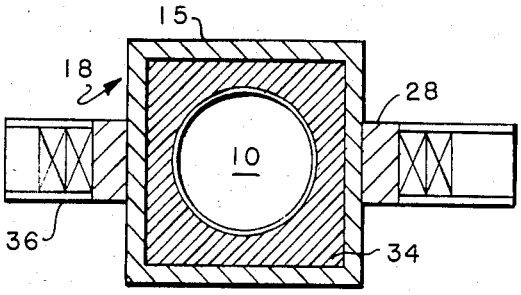
FIG. 8 is a similar section showing a modified chimney construction of the invention.

To the base block 16 are attached the first panels 22 of the first unit fastened to the base block by screws and having their corner edges fastened one to the other by screws (FIG. 9). On the base block 16, if desired, the first section of the stainless steel core 10 is placed, allowing for a corresponding opening in a side panel 22 as in the case of that first core section's having a clean-out opening 12. Fastened to the upper ends of the side panels 22 a holding block 24 is placed, held by screws to the side panels 22, as before.

Successive sections of the inner stainless steel core 10 are raised and fastened to each other by pop rivets, or the like, even as the side panels 22 and holding blocks 24 are raised. In this manner, step by step the chimney is erected.

Figure 10:
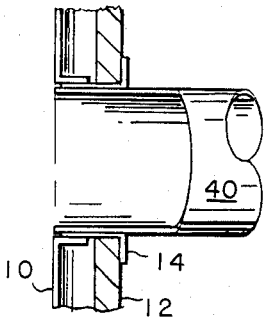
FIG. 10 is a fragmentary vertical sectional view of a portion of a novel chimney at an appliance connecting opening showing a smoke pipe mounted therein.

Referring to FIG. 2, in the case where a clean-out at the base of the chimney structure 18 is not required, the first inner core section of stainless steel having an appliance outlet 12 in it begins at a suitable height to allow for appliance installation, resting on a block 24 supported on assembled panels 22A. In this instance the appliance outlet 12 also serves as a clean-out. As shown in FIG. 10, a smoke pipe 40 from a stove or the like may be introduced through the appliance opening. A corresponding opening in the appropriate side panel 22 matches outlet 12 in the stainless steel core at that same height. As noted above, when the first section of the stainless steel core 10 is at an elevated height the holding block 24 (FIG. 2) at that height also serves as an elevated base block, being of the required thickness to prevent a burn-through in the worst case situation.

Method of Raising

The procedure for raising the novel chimney of the invention will now be described.

Figure 12:
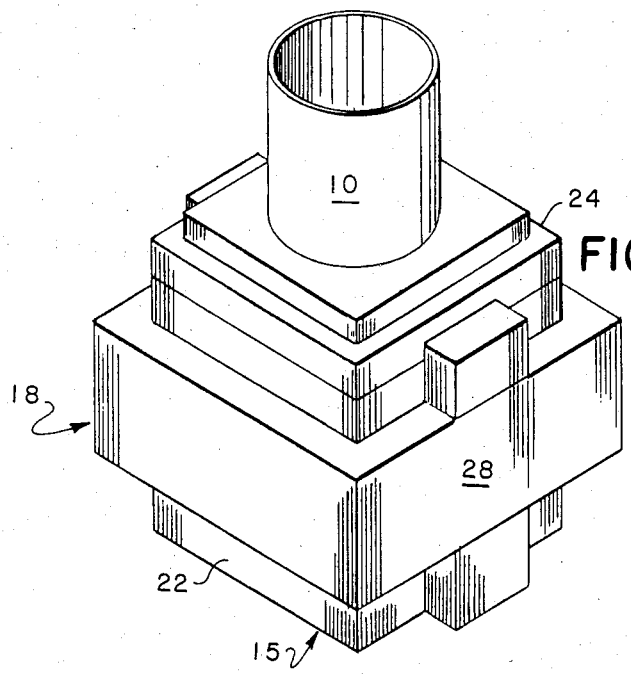
FIG. 12 is a view of the same after assembly including spacing blocks for engagement with abutting flammable floors, ceilings, or roof.

Referring to FIG. 1, the base 16 is placed on a suitable support, such as a basement floor F, and a first stainless steel tubular section 10 closed with stainless steel bottom cap 30 is placed in a cavity 38 formed in the top surface thereof. In this case the first tubular section is provided with a clean-out port 12. Next, panels 22 are attached to cover the sides of the core, one of them defining an opening in registry with that in the core member. The components are so dimensioned that a suitable insulating space exists between the outer surface of the core and the nearest adjacent inner surfaces of the enclosure defined by the panels. The way in which the parts fit together will be apparent from the exploded view of FIG. 11 and the assembled view of FIG. 12.

Figure 3:
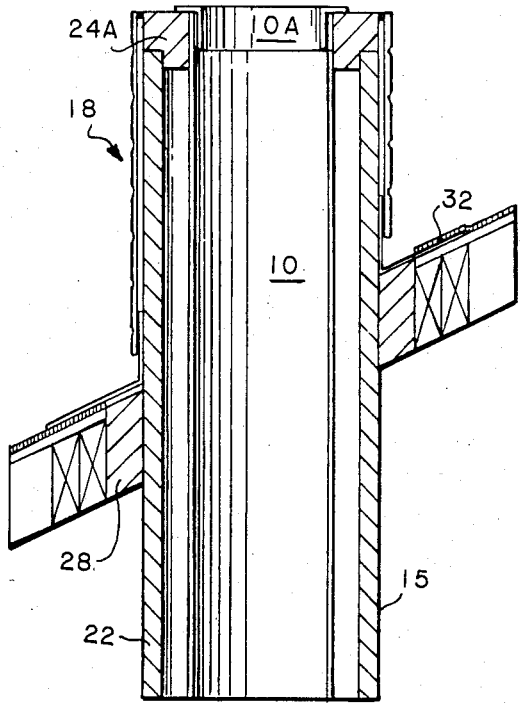
FIG. 3 is a vertical section through the top portion of a chimney embodying the invention showing its passage through the roof of a building.
Figure 5:
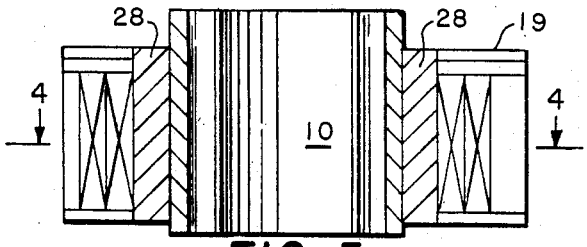
FIG. 5 is a vertical section of a portion of the novel chimney where it passes through a floor or ceiling.
Figure 7:
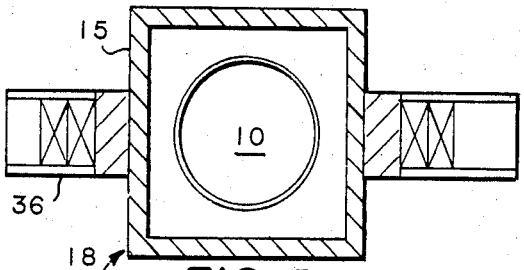
FIG. 7 is a horizontal section taken on line 7—7 of FIG. 6.

If any outer panel surface in the finished structure is to be only two inches away from flammables, that space is filled by a two-inch spacing block 28 (FIGS. 3–8) made of calcium silicate and fixed to the side panels 22 of the chimney structure with a high temperature silicone mastix (not shown). This would be the case as the structure is raised either through a floor or ceiling 19 (FIG. 5), or roof 32 (FIG. 3) and when the structure abuts a partition 36 (FIGS. 6 and 7). These insulating spacing blocks not only insulate the structure from the surrounding flammables but also enforce the two-inch clearance as required by code. These spacing blocks 28 also act to center the chimney structure 18 as it passes through surrounding structural elements consisting of floor, ceiling or roof thus preventing any lateral movement.

The process of raising the chimney structure continues as the holding blocks 24 are placed, side panels 22 are attached, and the inner stainless steel core 10 is slipped together and fastened with pop rivets (not shown). It will be noted that there is none but a frictional engagement between the steel core and the holding blocks to allow for expansion and contraction.

When the structure reaches the desired height above the roof 32 a holding block 24A (FIG. 3), having a male side only on the bottom, is placed on the top of the last section of side panels 22 allowing the last section of the stainless steel core 10 to pass through the holding block ending at a point flush with the top of the holding block. A flanged short section 10A of stainless steel core is then slipped into that uppermost core section and the junction of the flange and the holding block is caulked with a weatherproof sealant (not shown).

The outside of the chimney above the roof is then either stuccoed with a weatherproof plaster mix or is covered by an applique of suitable material such as a brick veneer, tiles, or slates, as desired. The junction of chimney and roof on the exterior roof side is also suitably flashed.

The surface of the chimney structure within the building in a room space may be finished off in the same manner that a gypsum wall of similar appearance would be finished. The structure as it joins with walls or partitions and with ceilings forming a flush surface may be taped on the seams with a non-flammable fiberglass tape and skim-coated with a plaster mix suitable for that purpose in a manner well-known to builders.

Referring to FIG. 7, as an optional consideration in the raising process of the novel chimney, the space between the side panels 22 and the inner stainless steel core 10 may be filled, as shown, with either a poured-in insulation 34 or one that is tamped in place as the sections are constructed, thus filling that space and further enhancing the insulative qualities of the side panels 22.

The outer structure of calcium silicate panels 22 and holding blocks 24 are not at any point mechanically connected to the inner core 10 and, where they do meet with the inner core, the joint is only one of friction.

Advantages of the Invention

A dramatic difference from the prior art is that, so far as I am aware, no chimney previously has addressed the problem of integrating a chimney with abutting flammables, specifically wood-framed structural components sheathed with gypsum board (sheetrock).

The novel structure not only allows that to be done but also enforces the two-inch clearance required by code from a masonry-type chimney to flammables by filling that space with insulating blocks.

In essence, the outside of the chimney becomes the finished interior wall of a living space with the only treatment being the same as required in the finishing of a gypsum wall. However, of greater interest is the integration of the spacing blocks between the chimney structure and the flammables. The surface of the spacing block is placed flush with the gypsum (sheetrock) surface thus permitting the appearance of the gypsum wall to continue unbroken and to be joined with the chimney structure without requiring any finishing techniques other than those normally applied to a gypsum wall.

Thus there are many advantages to this novel chimney among them the following:

1. Because the chimney integrates so well with the abutting flammables no great means are required to continue the appearance of a gypsum (sheetrock) wall around or in front of the chimney thus allowing the chimney to be placed in a much smaller space.

2. The chimney is very light in comparison to masonry chimneys thus allowing construction to begin on any floor of a building without requiring a cellar footing or foundation.

3. The entire chimney can be erected with little more than a screwdriver and a pop rivet gun.

4. The safety factor is extremely high. Even if the stainless steel inner core should fail, the calcium silicate outer shell would be more than enough to contain burning flue gases. In fact, the calcium silicate might, in essence, qualify as a flue without the inner core. However, this would not be a recommended use for calcium silicate.

5. The novel chimney system is a light weight flue system that permits the appearance of the chimney above the roof to be that of masonry (brick, tile or stucco). The systems in present use for creating this appearance around cylindrical flues are by no means as good and must be constructed above the roof around the flue stack after it penetrates the roof.

6. A further advantageous aspect is that the sectional components are light enough to be shipped by parcel delivery systems rather than by freight.

While there has herein been disclosed and described presently preferred embodiments of the invention, it will nevertheless be understood that the same is susceptible of modification and change by those skilled in the art and accordingly it is intended that the scope of the invention be limited only by the proper interpretation to be afforded the appended claims.

I claim:

1. A chimney structure comprising a base member of fireproof material, a hollow metallic core resting on said base member, said core comprising a stacked series of individual hollow cylindrical metal sections joined together to define a vertical flue of the required length extending upwardly from said base member, said core having at least one opening at a desired height above said base suitable for use as a clean-out and/or appliance connection, a vertical enclosure surrounding and spaced from said core comprising vertically stacked box-like units formed of at least three side panels each and holding blocks separating said units from each other vertically, the lowermost of said units resting on said base member, each of said holding blocks having a radially inwardly extending flange engaging said core and holding it centered within said enclosure and a radially outwardly extending flange for receiving and seating the top and bottom edges of successive box-like units respectively, said panels and holding blocks being composed of high structural strength non-flammable thermal insulating material, and lateral spacing blocks of similar material spacing the exterior surfaces of said panels from any flammable materials surrounding said chimney structure.

2. The structure of claim 1 wherein each of said units comprises four rectangular panels of calcium silicate joined together at their vertical edges to form a rectangular hollow tubular unit.

3. The structure of claim 1 wherein said base member, said panels, said holding blocks and spacing blocks are composed of calcium silicate.

4. The structure of claim 1 wherein each of said units comprises four rectangular panels of calcium silicate joined together at their vertical edges to form a rectangular hollow tubular unit, said units being separated from each other by said holding blocks.

5. The structure of claim 1 wherein said core is composed of tubular sections of sheet stainless steel.

6. The structure of claim 5 wherein said stainless steel sections are joined together by riveting.

7. The structure of claim 5 including an uppermost holding centering said core at its upper end, the uppermost stainless steel section having its upper edge flush with the upper surface of said block and a flanged terminal stainless steel section fitted within the open end of said uppermost staniless steel section with its flange covering the upper surface of said uppermost holding block.

8. The structure of claim 1 wherein said base member is located at the ground level of a building and said structure is provided with a clean-out opening at ground level and an appliance connection opening at a higher level.

9. The structure of claim 1 including means for mounting said base member at an elevation above the base of said chimney.

10. The structure of claim 1 wherein said spacing blocks are integrated with a structural portion of a building.

11. The structure of claim 1 wherein the space between said core and said enclosure is filled with non-flammable insulating material.

12. A kit for raising a chimney structure comprising a bse member of fireproof material for placing the foot of the chimney for supporting the remaining components, hollow metallic core sections adapted to be stacked vertically and fastened to each other at their rims with the lowermost thereof resting on said base member to define a continuous central core, at least one of said sections of said core having an opening at a desired height above said base when said section is in its stacked position suitable for use as a clean-out and/or appliance connection, rectangular panels of substantially the same height as said units adapted to be fastened to each other along their edges in sets of four to form box like members open at both ends the one of said box-like members surrounding the one of said sections having an opening being provided with an opening in registry therewith, generally rectangular holding blocks each having a central opening sized to fit the outer circumference of said core and a peripheral flange adapted to seat an open end of a box-like member, said box-like members being adapted to be stacked one upon another separated by said blocks to define a vertical enclosure surrounding and spaced from said core with the lowermost resting on said base member, said panels and holding blocks being composed of high structural strength non-flammable thermal insulating material, and lateral spacing blocks of similar material adapted to be secured to the outer surfaces of said box-like members for separating the exterior surfaces of said panels from any flammable materials surrounding said chimney structure.

13. The kit of claim 11 wherein said base member, said panels, said holding blocks and spacing blocks are composed of calcium silicate.

14. The kit of claim 12 wherein said core sections comprise cylindrical tubular sections of sheet stainless steel.

15. The kit of claim 12 including an uppermost holding block for centering said core at its upper end with the uppermost section having its upper edge flush with the upper surface of said block and a flanged terminal stainless steel section adapted to be fitted within the open end of said uppermost section with its flange covering the upper surface of said uppermost holding block.

16. The method of raising a light-weight chimney structure which comprises providing a base on a suitable supporting surface, mounting a first stainless steel tubular section closed by a stainless steel bottom cap thereon, attaching four rectangular calcium silicate side panels to each other to form a box-like unit open at both ends and mounting the same on said base by attaching it to the upper surface thereof with the interior of said box-like unit spaced from the periphery of said tubular section, slipping a second tubular section partially into the top of the first and attaching it thereto to provide an upward prolongation thereof, providing a holding block having a central opening adapted to receive and fit a tubular section for centering the same in the structure and a peripheral flange adapted to seat an open end of a box-like unit and mounting it on top of said first box-like unit, the joint between said tubular sections being received in said central opening, continuing the raising by stacking additional box-like units, tubular sections and holding blocks on those below, the stacked sections defining a central core and the stacked box-like units a shell surrounding and spaced from said core, and terminating the structure with an uppermost block havin the upper edge of the uppermost tubular section flush therewith and a flanged terminal section fitted within the open end of said last named section with its flange covering the upper surface of said uppermost block.

17. The method according to claim 15 including the step of attaching spacing blocks of calcium silicate to the exteriors of at least some of said side panels at suitable elevations to insulate said chimney structure from any surrounding flammables as the structure is raised through either a floor, ceiling, or roof.

18. The method according to claim 16 in which said panels are held to each other and to the corresponding base and blocks by screws.

19. The method according to claim 15 in which said stainless steel sections are riveted together.

20. The method according to claim 16 including the step of joining said shell with a wall flush therewith and finishing the flush surfaces by taping and skim-coating with a plaster mix.

21. The method according to claim 16 including the step of filling the space between the steel core and the surrounding shell with insulation.

22. A chimney structure comprising a base member of fireproof material, at least one hollow metlalic core resting on said base member, said core comprising a stacked series of individual hollow cylindrical metal sections joined together to define a vertical flue of the required length extending upwardly from said base member, said core having at least one opening for use as a clean-out and/or appliance connection, a vertical enclosure surrounding and spaced from said core comprising vertically stacked box-like units formed of at least three side panels each, the lowermost of said units resting on said base member, said panels being composed of high structural strength thermally insulating material, holding members mounted within said enclosure each having a radially inwardly extending portion engaging and centering said core within said enclosure said holding members being composed of high structural strength non-flammable material, and p1 non-flammable lateral spacing blocks spacing and thermally insulative the exterior surfaces of said panels from any flammable material surrounding said chimmey structure.

* * * * *

UNITED STATES PATENT AND TRADEMARK OFFICE

CERTIFICATE OF CORRECTION

PATENT NO. : 4,731,967

DATED : March 22, 1988

INVENTOR(S) : Stephen D. McLaughlin

It is certified that error appears in the above-identified patent and that said Letters Patent are hereby corrected as shown below:

Col. 3 line 45, "emboding" should read -- embodying --

Figure 11:
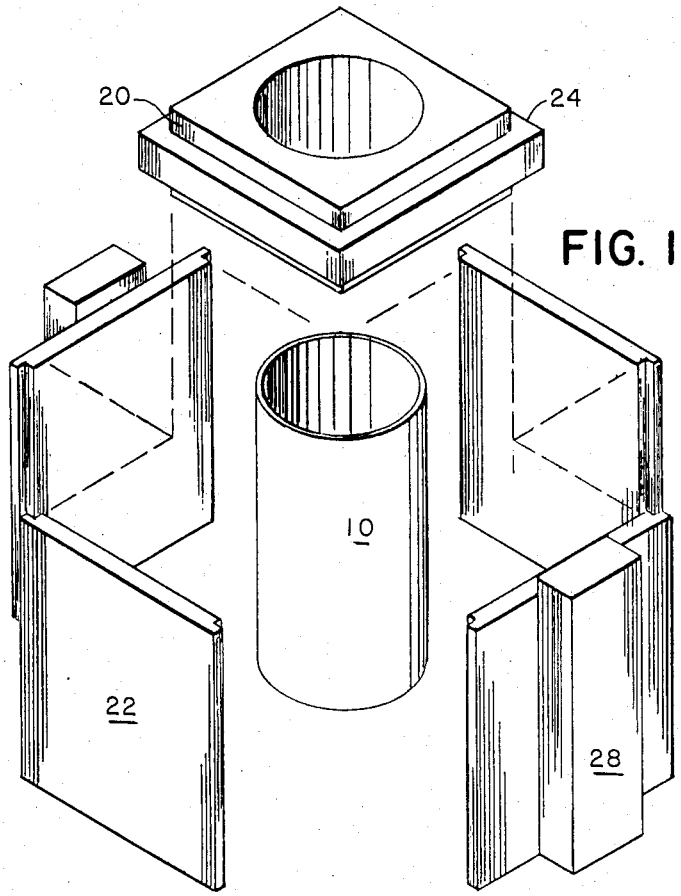
FIG. 11 is a fragmentary vertical sectional view of a portion of a novel chimney at an appliance connecting opening showing a smoke pipe mounted therein.

Col. 3 line 66 - 68, delete the following: "Fig. 11 is a fragmentary vertical sectional view of a portion of a novel chimney at an appliance connecting opening showing a smoke pipe mounted therein;"

Col. 4 line 31, after "22" insert -- . --

Col. 8 line 11, after "holding" insert -- block --

Col. 8 line 15, "staniless" should read -- stainless --

Col. 8 line 33, "bse" should read -- base --

Col. 8 line 33, after "placing" insert -- at --

Col. 9 line 1, change "11" to -- 12 --

Col. 9 line 44, "havin" should read -- having --

Col. 10 line 3, change "15" to -- 16 --

Col. 10 line 12, change "15" to -- 16 --

Col. 10 line 23, "metlalic" should read -- metallic --

Col. 10 line 43, delete "pl"

UNITED STATES PATENT AND TRADEMARK OFFICE

CERTIFICATE OF CORRECTION

PATENT NO. : 4,731,967

DATED : March 22, 1988

INVENTOR(S) : Stephen D. McLaughlin

It is certified that error appears in the above-identified patent and that said Letters Patent is hereby corrected as shown below:

Col. 10, line 44, "insulative" should read -- insulating --.

Signed and Sealed this

Second Day of August, 1988

*Attest:*

DONALD J. QUIGG

*Attesting Officer*

*Commissioner of Patents and Trademarks*